United States Patent [19]

Trage et al.

[11] Patent Number: 4,550,570

[45] Date of Patent: Nov. 5, 1985

[54] FORCED-AIR COOLED CONDENSER SYSTEM

[75] Inventors: Burghard Trage; Franz-Josef Hintzen; Richard Leitz, all of Ratingen, Fed. Rep. of Germany

[73] Assignee: Balcke-Dürr Aktiengesellschaft, Ratingen, Fed. Rep. of Germany

[21] Appl. No.: 629,631

[22] Filed: Jul. 11, 1984

[30] Foreign Application Priority Data

Jul. 12, 1983 [DE] Fed. Rep. of Germany ..... 3325054

[51] Int. Cl.[4] ..... F28B 1/06

[52] U.S. Cl. ..... 60/693; 60/690; 165/126; 165/900

[58] Field of Search ..... 165/DIG. 1, 126; 60/690, 693

[56] References Cited

U.S. PATENT DOCUMENTS 3,519,068 7/1970 Harris et al. ..... 165/DIG. 1
4,029,144 6/1977 Harris ..... 165/DIG. 1

FOREIGN PATENT DOCUMENTS 1153779 9/1963 Fed. Rep. of Germany .
2454455 5/1976 Fed. Rep. of Germany .
1170415 11/1969 United Kingdom ..... 165/DIG. 1
2086559 5/1982 United Kingdom ..... 165/DIG. 1

*Primary Examiner*—Albert W. Davis, Jr.
*Attorney, Agent, or Firm*—Becker & Becker, Inc.

[57] ABSTRACT

A forced-air cooled condenser system having a plurality of roof-shaped heat exchange elements of finned tubes, to which cooling air is supplied via fans, and to which the steam which is to be condensed is supplied via a steam distribution line which forms the ridge of the elements. The heat exchange elements, which are located directly adjacent to the turbine housing, are disposed next to one another or side by side. The ridges of the heat exchange elements are disposed parallel to one another. In order to prevent the danger of a recirculation of the warm air which leaves the heat exchange elements, that heat exchange element which is spaced the furthest from the turbine housing is disposed higher than the heat exchange elements which are located therebetween. This is preferably accomplished via higher supports than exist for the heat exchange elements located therebetween.

6 Claims, 2 Drawing Figures

FORCED-AIR COOLED CONDENSER SYSTEM

BACKGROUND OF THE INVENTION

1. Field of the Invention

The present invention relates to a condenser system which is forced-air cooled and includes a plurality of roof-shaped heat exchange elements of finned tubes, to which the cooling air is supplied by fans, and to which the steam which is to be condensed is supplied by a steam distribution line which forms the ridge of the elements. The heat exchange elements, which are disposed directly next to a turbine housing, are disposed adjacent to or one after the other, and the ridges thereof are aligned parallel to one another.

2. Description of the Prior Art

In the recent past, there has been a recognizable trend to continuously larger power plant outputs with direct condenser systems. Steam exhaust from the turbines is conveyed via large-volume conduits directly into forced-air cooled heat exchange elements of finned tubes where it is condensed. The cooling air is delivered by fans which are customarily disposed on the intake air side below the heat exchange elements. To avoid long paths, which result in a reduction of the condensation temperature and hence a reduction of the efficiency of the condensation, the heat exchange elements are disposed directly next to the turbine housing.

Condenser systems are known according to which, to reduce the space required, the heat exchange elements are roof-shaped, with the ridge thereof being formed by the steam distribution line. Since the length of a heat exchange element is limited for thermohydraulic reasons, the roof-shaped heat exchange elements are preferably disposed parallel to the front of the turbine housing, so that despite the limited length of the heat exchange elements, the overall condenser system can be constructed as deep as desired.

Especially, when for reasons of space, a plurality of power plant units are arranged in a row next to one another, unfavorable in-flow conditions result with regard to the air flow for the inwardly disposed heat exchange elements of the condenser system. Due to the turbine housing, as well as the adjacent heat exchange elements, virtually three of the four sides of the heat exchange elements are blocked off as in-flow cross-sectional areas for the cooling air. The air velocity on the remaining free side is therefore very high, since all of the fans must be supplied with fresh or intake air via this cross-sectional area.

Experiments have shown that the recirculation of warm air, i.e. of cooling air which has been warmed up by absorbing heat as it flows through the heat exchange elements, also increases as the velocity of the intake air supplied to the fans increases. In this case, the fans draw in an air mixture which has a higher temperature than does the atmospheric air. The immediate result is a reduction of the cooling capacity, and hence a reduction of the efficiency of the condenser system. The recirculation rate of the exhaust or outlet air increases especially when there is encountered a cross wind, the direction of which extends opposite to the in-flow direction of the cooling air, because the cross wind deflects the warm air which leaves the heat exchange elements in the direction toward the in-flowing intake air.

Thus, an object of the present invention to provide a forced-air cooled condenser system of the aforementioned general type according to which the recirculation of warm exhaust air is considerably reduced, even under unfavorable wind conditions, without having to install expensive wind or air guiding apparatus in order to achieve this.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 1:
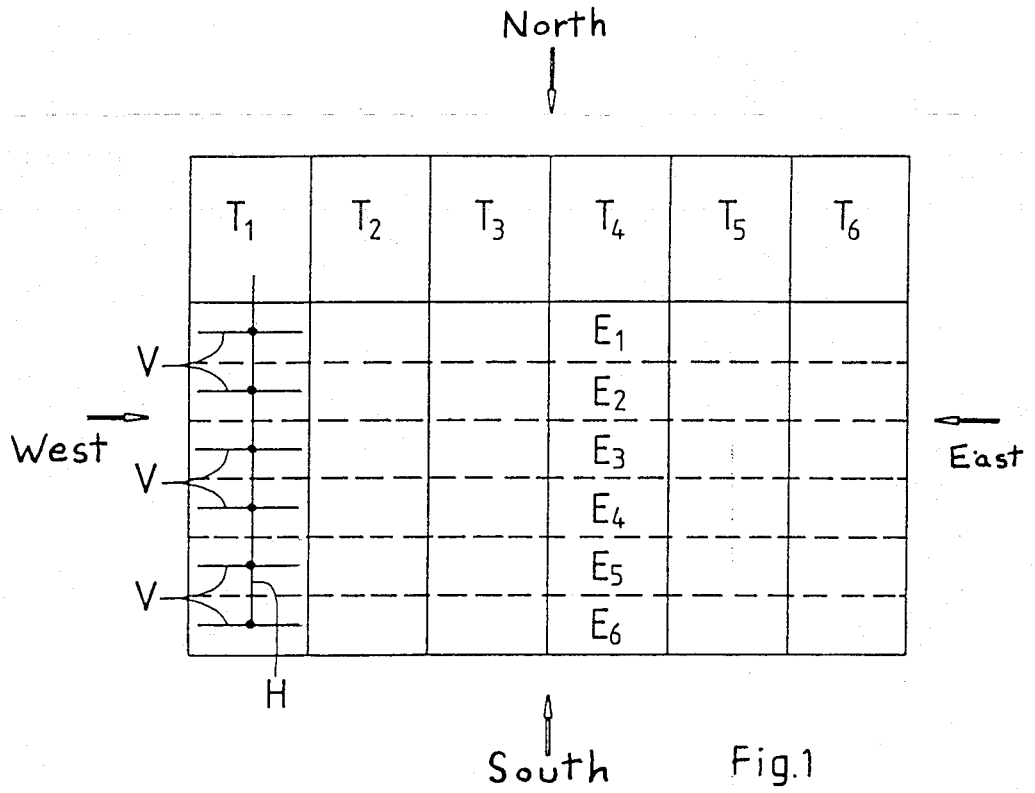
FIG. 1 is a plan view of one inventive embodiment of a forced-air cooled condenser system for a plurality of adjacent power plant units.

The condenser system of the present invention is characterized primarily thereby that heat exchange element which is disposed at the greatest distance from the turbine housing is higher than the heat exchange elements located therebetween.

The result of the inventive proposal is that cross winds have come from the direction of the turbine housing and which pass over the heat exchange elements which are disposed next to one another, are deflected upwardly by that heat exchange element which is spaced the furthest from the turbine housing, because this last-mentioned heat exchange element is higher than those heat exchange elements located therebetween. The exhaust or outlet air leaving this last heat exchange element enhances the deflection action exerted upon the cross wind. The inventive proposal thus reduces the susceptibility of the forced-air cooled condenser system to recirculation, thus at the same time increasing the net output of the power plant.

Pursuant to a preferred embodiment of the present invention, that heat exchange element which is spaced the furthest from the turbine housing is arranged on higher supports than are the heat exchange elements which are disposed therebetween. As a result, reduction of the inlet velocity of the intake air is possible to such an extent that on the one hand, the in-flow losses of the intake air can be reduced, which has a favorable effect on the power required by the fans for cooling, and on the other hand, considerably reduces the danger of recirculation. When a cross wind is encountered from the unfavorable direction of the turbine housing, this cross wind is deflected in an inclined, upwardly directed direction due to the high arrangement of the last heat exchange element, so that the full dynamic portion of the cross wind is no longer available for generating recirculation, resulting in the lowering of the recirculation rate.

Pursuant to a further feature of the present invention, the heat exchange elements can be disposed on supports of different heights either individually or in groups of several heat exchange elements which are arranged side by side; the height of the supports increases incrementally as the distance from the turbine housing increases. This arrangement improves the deflection action upon the cross wind, and provides more favorable conditions for the supply of cooling air to the underside of the heat exchange elements, especially when a plurality of heat exchange elements are disposed not only parallel to one another, i.e. at an increasing distance from the turbine housing, but also a plurality of heat exchange elements are disposed consecutively, as is the case especially with the existence of several power plant units.

Finally, there is proposed pursuant to the present invention to adapt the in-flow cross-sectional area of the cooling or intake air in the vertical planes between the individual heat exchange elements; this in-flow cross-sectional area varies in size due to the various heights of the supports, to the respective air requirement of the fans, so that the conditions on the intake side of the forced-air cooled condenser system are also optimized.

DESCRIPTION OF PREFERRED EMBODIMENTS

Referring now to the drawing in detail, in the illustrated embodiment there is shown a forced-air cooled condenser system for a total of six power plant units, the turbine housings $T_1$ to $T_6$ of which are disposed directly next to one another. Associated with each turbine housing $T_1$ to $T_6$ are six heat exchange elements $E_1$ to $E_6$, which are connected directly to the back side of the respective turbine housings $T_1$ to $T_6$.

Figure 2:
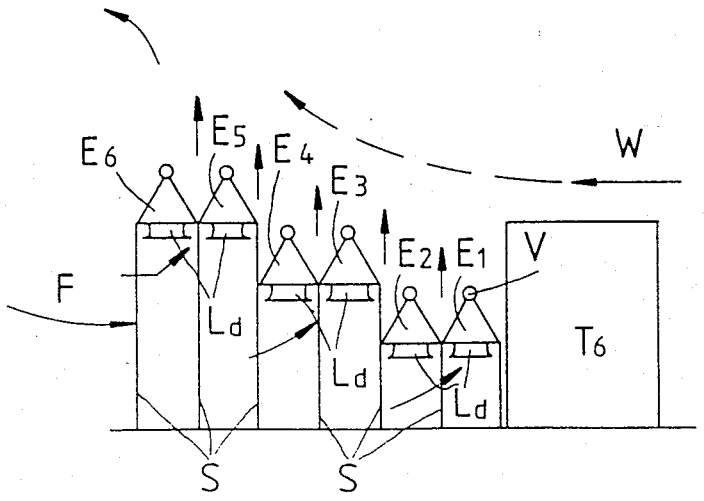
FIG. 2 is a side view of the arrangement of FIG. 1.

As shown in particular in the side view of FIG. 2, each heat exchange element E is constructed in a roof-shaped manner of finned tubes; a steam distribution line V forms the ridge of each heat exchange element E. All of the ridges of the heat exchange elements E of a given turbine housing T are not only parallel to one another, but are also parallel to the front side of the turbine housing T. The heat exchange elements E of a given turbine housing T communicate via a main line H with the turbine, which is not illustrated in the drawing.

The heat exchange elements $E_1$ to $E_6$ are arranged in pairs on supports S of different lengths, which lengths increase as the distance from the turbine housing T increases. As a result, the inlet velocity of the fresh or intake air F is reduced, thus reducing the danger of recirculation; furthermore, the in-flow losses of the intake air F are reduced, which has a favorable effect on the power required of the fan $L_d$ for cooling. When a cross wind W is encountered from the unfavorable direction of the turbine housing C, which in the plan view of FIG. 1 would be from the direction north, this cross wind W, due to the sloping arrangement of the heat exchange elements $E_1$ to $E_6$ which are disposed one after the other in the direction of the wind, is deflected in an inclined, upwardly directed direction, so that on the one hand the full dynamic portion of the wind is no longer available for the generation of recirculation, and on the other hand the warm air which emerges from the last heat exchange element $E_6$ and which is particularly susceptible to recirculation, is first deflected in the direction of the intake air F at a considerable height. The intake air supplied to the bottom side of the heat exchange elements E is thus not mixed with warm outlet air from the exhaust elements E. The cross-sectional area of the in-flow of the intake air F, which varies in magnitude due to the different heights of the supports S, in the individual vertical planes between the individual heat exchange elements $E_1$ to $E_6$, therefore can be adapted to the respective air requirement of the fans $L_d$.

The present invention is, of course, in no way restricted to the specific disclosure of the specification and drawing, but also encompasses any modifications within the scope of the appended claims.

What we claim is:

1. In a forced-air cooled condenser system having a plurality of roof-shaped heat exchange elements of finned tubes, to which cooling intake air is fed via fans, and to which steam which is to be condensed is fed via steam distribution lines, each of which forms a ridge of a given one of said heat exchange elements; the heat exchange elements are disposed directly by a turbine housing, and are disposed next to one another or consecutively, with the ridges of said heat exchange elements being disposed parallel to one another;

the improvement therewith which comprises having that heat exchange element, which is spaced the furthest from said turbine housing, arranged structurally higher than the heat exchange elements located therebetween so that, on one hand, in-flow losses of intake air can be reduced thereby having a favorable effect upon power required for cooling, and on the other hand, considerably reducing danger of recirculation of warmed air from the heat exchange elements due to inclined upwardly directed direction due to higher arrangement of that heat exchange element spaced furthest from said turbine housing.

2. A condenser system according to claim 1, which includes supports for said heat exchange elements; the supports for said heat exchange element which is spaced the furthest from said turbine housing being structurally higher than the supports for the heat exchange elements located therebetween.

3. A condenser system according to claim 2, in which said supports increase incrementally in height as distance thereof from said turbine housing increases.

4. A condenser system according to claim 3, in which said heat exchange elements are individually disposed on said supports.

5. A condenser system according to claim 3, in which said heat exchange elements are disposed on said supports in groups comprising several heat exchange elements which are disposed next to one another.

6. A condenser system according to claim 3, which includes vertical planes between individual heat exchange elements for intake air for said fans; said vertical planes having cross-sectional areas which vary in conformity with the varying heights of said supports, and which are adapted to the air requirements of the respective fans.

* * * * *